US006101673A

United States Patent [19]

Edin

[11] Patent Number: 6,101,673

[45] Date of Patent: Aug. 15, 2000

[54] TUBE SHAFT FOR A VACUUM CLEANER

[75] Inventor: Anders Edin, Järfälla, Sweden

[73] Assignee: Aktiebolaget Electrolux, Stockholm, Sweden

[21] Appl. No.: 09/295,260

[22] Filed: Apr. 20, 1999

[30] Foreign Application Priority Data

May 4, 1998 [SE] Sweden ..... 9801546

[51] Int. Cl.[7] ..... A47L 5/36

[52] U.S. Cl. ..... 15/414; 15/327.1

[58] Field of Search ..... 15/327.1, 377, 15/414; 285/7, 302

[56] References Cited

U.S. PATENT DOCUMENTS

| | | | |
|---|---|---|---|
| 1,104,148 | 7/1914 | Spencer . | |
| 1,864,182 | 6/1932 | Boyer | 15/414 |
| 2,074,032 | 3/1937 | Bank | 285/7 |
| 2,623,234 | 12/1952 | Brown | 15/414 X |
| 2,624,061 | 1/1953 | Leas | 15/414 X |
| 2,710,204 | 6/1955 | Faith-Ell | 285/7 |
| 3,083,041 | 3/1963 | Owenmark | 285/302 X |
| 3,244,437 | 4/1966 | Belicka et al. | 15/414 X |
| 3,351,359 | 11/1967 | Ferraris | 285/7 |
| 5,740,583 | 4/1998 | Shimada et al. | 15/414 X |
| 5,927,758 | 7/1999 | Carlsson | 285/7 |

*Primary Examiner*—Chris K. Moore
*Attorney, Agent, or Firm*—Pearne & Gordon LLP

[57] ABSTRACT

A tube shaft (14) for a vacuum cleaner having an upper end and a lower end. The upper end is connected to a tube handle (15) or the like communicating with a vacuum source and a particle separating means. The lower end is connected to a nozzle (13). The tube shaft (14) includes at least two sections (17,18) arranged telescopically with respect to one another and the parts of the sections which are telescopically arranged with respect to one another are curved.

16 Claims, 1 Drawing Sheet

TUBE SHAFT FOR A VACUUM CLEANER

BACKGROUND OF THE INVENTION

The present invention relates to a vacuum cleaner tube shaft having an upper end and a lower end, the upper end being connected to a tube handle or the like communicating with a vacuum source and a particle separating means and the lower end being connected to a nozzle, the tube shaft comprising at least two sections arranged telescopically with respect to one another.

Tube shafts of the type mentioned above are previously known and are used to adjust the length of the tube shaft with respect to the height of the operator in order to achieve a comfortable working position. A further advantage is that such a tube shaft is rather space saving when it is pushed together for storage. Previously known tube shafts comprise straight, stiff tube sections which means that such tube shafts are easy to handle on open floor surfaces but create problems when cleaning beneath low furniture and objects. In order to reach below these objects the operator has to bend over and lower the tube shaft such that the nozzle reaches sufficiently far under the object. This creates an uncomfortable working position and makes cleaning work cumbersome, particularly for elderly people.

In order to eliminate this problem it has previously been suggested, see WO 89/07412, to use a flexible element such as a hose between two sections of the tube shaft making it possible to place the lower section of the tube shaft in such a position that it is parallel to the floor surface. However, this arrangement is very primitive and makes it difficult to guide the tube shaft in its normal working position because of the flexibility of the hose. A similar arrangement, but with complementary elements to stabilize the two sections with respect to one another, is also previously known, see SE 9600650. Unfortunately, this arrangement is very complicated because of the existence of several ball joints, telescopically arranged components and complementary tube sections.

Further it is previously known, see JP 7255653, to manufacture the complete tube shaft or parts of it from flexible material which means that the tube shaft can be pushed in below objects and become bent when contacting the objects. Even if such a tube shaft is pleasant, in the abstract, it is difficult to find material compositions giving the necessary flexibility while, at the same time, providing sufficient rigidity or stability during normal use.

Moreover, U.S. Pat. No. 1,012,195 and U.S. Pat. No. 1,104,148 describe other types of arrangements for facilitating cleaning operations below furniture. U.S. Pat. No. 1,012,195 describes a tube shaft comprising two parts. The two parts include a lower straight part and an upper handle part. The upper handle part has a short air inlet section that is inclined with respect to an elongated air outlet section. When cleaning below furniture, the upper part must be turned or rotated about 180°. This, however, means that the handle part has to be moved to a position near the floor which is just as uncomfortable as the position required when using ordinary tube shafts.

U.S. Pat. No. 1,104,148 describes an arrangement having a bent tube shaft that can be turned through 90° at each side of a central upraised position. However, when the tube shaft is turned to one of the side positions the operator is forced to move the handle part towards the floor in order to reach under furniture. Consequently, this arrangement has the same disadvantages as the arrangement described-above with regard to U.S. Pat. No. 1,012,195.

SUMMARY OF THE INVENTION

The present invention is directed toward a simple and cheap arrangement that makes it possible to adjust the tube shaft between a normal position and a position in which cleaning below low furniture or other objects is possible without the need for the operator to bend heavily. The present invention is further directed toward an arrangement wherein the stability of the tube is not reduced due to the presence of a flexible element or a flexible material.

In accordance with the present invention, a tube shaft for a vacuum cleaner includes an upper end and a lower end. The upper end of the tube shaft is connected to a tube handle or the like communicating with a vacuum source and a particle separating means. The lower end of the tube shaft is connected to a nozzle.

In further accordance with the present invention, the tube shaft includes at least two sections that are at least partially movable in a telescopic fashion with respect to one another. Portions of the sections that are telescopically arranged with respect to one another are curved, and lie along the same arc. A locking device is provided to permit the telescopically-arranged portions and, hence, the two sections, to be releasably secured to one another in plural positions.

BRIEF DESCRIPTION OF THE DRAWINGS

These and further features of the present invention will now be described with reference to the accompanying drawings, wherein.

DETAILED DESCRIPTION OF THE PREFERRED EMBODIMENT

Figure 2:
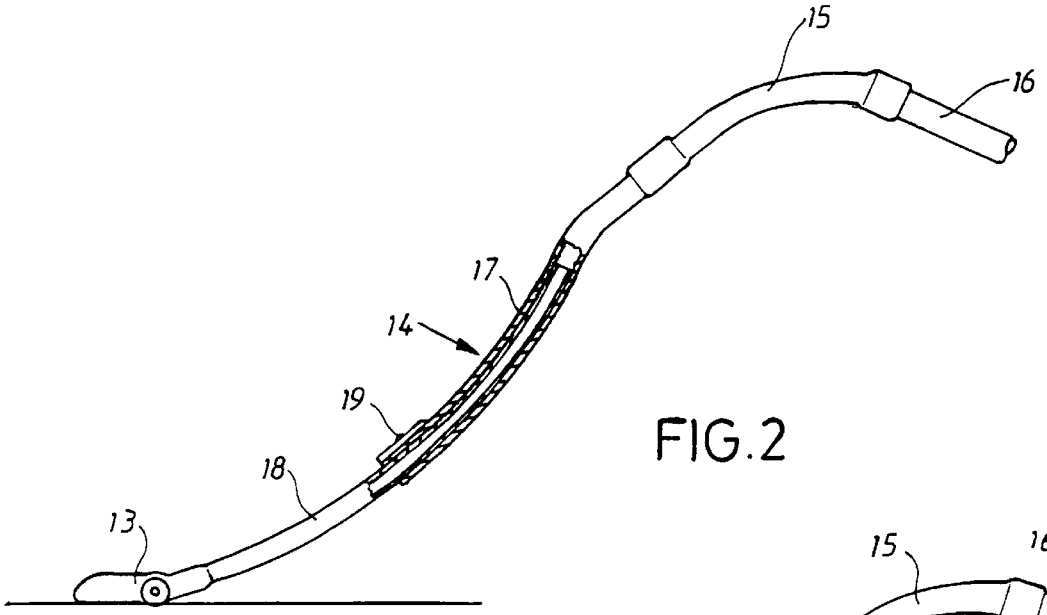
FIG. 2 shows schematically a side view of the tube shaft according to the invention during normal use; and, FIG. 3 shows the same view as FIG. 2 when the tube shaft is adapted for cleaning below low furniture.
Figure 3:
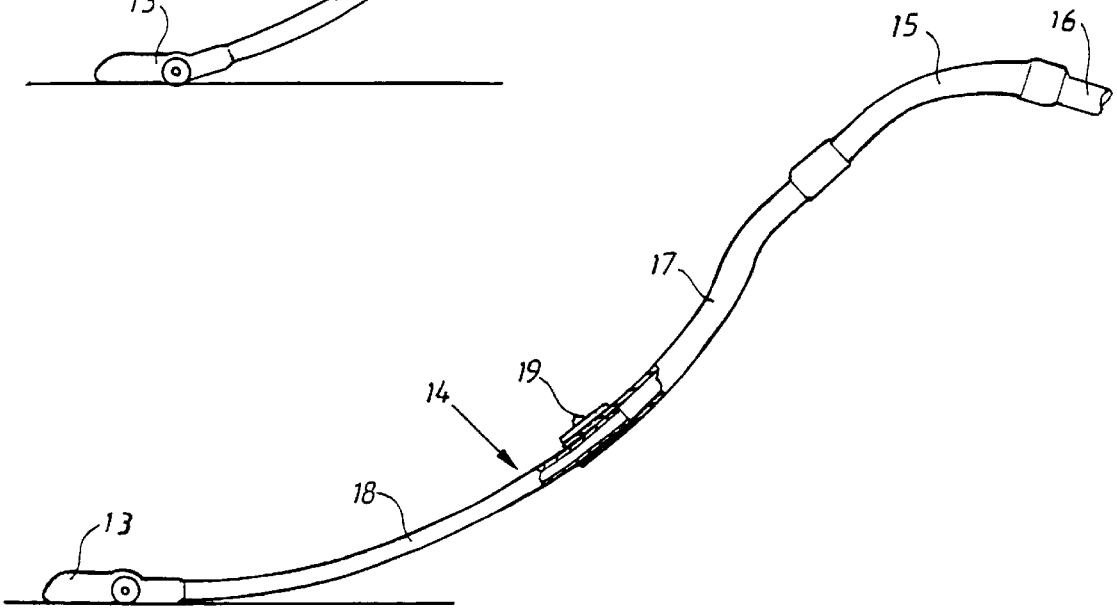
Figure 1:
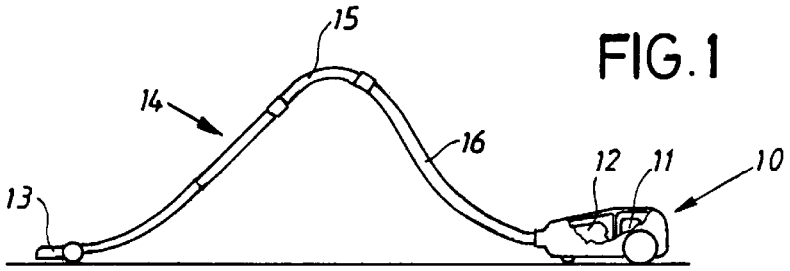
FIG. 1 shows a side view of a canister vacuum cleaner.

With reference to FIG. 1, a vacuum cleaner includes a vacuum cleaner housing 10 enclosing a vacuum source 11, such as a fan unit, and a compartment for a particle-separating filter bag 12. A nozzle 13 and a tube shaft 14 are, via a tube handle 15 and a flexible hose 16, connected to the vacuum cleaner housing 10. Dust-laden air flows from the nozzle 13 into the bag 12 in which particles are separated and collected before the air continues through the fan to atmosphere. The vacuum source 11, as well as the particle separating means, can also be placed close to the tube handle 15. It is also possible to connect the hose 16 to a socket for a so-called central vacuum cleaner.

The tube shaft 14 comprises two sections 17, 18, which are at least partially curved and have a configuration or design such that at least a portion of one section 18 is telescopically movable into a corresponding portion in the other section 17. The sections 17 and 18 are, by means of a locking device 19, locked in at least two positions with respect to one another. In the illustrated and preferred embodiment, the upper section 17 has a larger inner diameter than the lower section 18. Thus, the lower section 18 is telescopically received in the upper section 17. Naturally, it is contemplated and possible to invert the illustrated arrangement which, however, has the advantage that the connecting device 19 is disposed relatively closer to the hands of the operator. The two sections 17, 18 have, at least along a part of their length, a curvature which is such that the radius of curvature of the sections cooperate to define portions of the same arc of circle.

The tube shaft 14 is used in the following manner. During normal vacuum cleaning operations the lower section 18 is partially inserted into the upper section 17 and is secured thereto by means of the locking device 19. When cleaning below low objects, the locking means 19 between the two sections 17, 18 is released and then the lower section 18 is partly pulled out from the upper section 17 before the two sections are again locked to one another. This means that the tube shaft 14 is extended and that the lower section 18 now can be lowered towards the floor such that the nozzle 13 can be pushed in beneath low objects without the need for the operator bend heavily.

Thus, the present invention makes it possible to use two or more tube sections having curved or bent portions in such a way that the tube sections together achieve such a geometry that cleaning below low objects is facilitated. The geometry is adjusted with regard to the nozzles and the tube shaft that is used for different available applications. It should in this connection also be noted that the tube handle, if desired, also can be a part of the curved sections of the tube shaft. For example, the parts 15 and 17 may form one integrated unit.

What is claimed is:

1. A tube shaft (14) for a vacuum cleaner comprising an upper end and a lower end, the upper end being connected to a tube handle (15) communicating with a vacuum source and a particle separating means, the lower end being connected to a nozzle (13), said tube shaft (14) comprising at least two sections (17,18) that are arranged telescopically with respect to one another, wherein portions of the sections that are telescopically arranged with respect to one another are curved.

2. A tube shaft according to claim 1, wherein said curved portions are shaped as arcs of a single circle.

3. A tube shaft according to claim 2, wherein the tube shaft section (17) disposed near the tube handle has a larger outer diameter than the tube shaft section (18) disposed near the nozzle (13).

4. A tube shaft according to claim 3, wherein one of the sections is an integrated part of the tube handle (15).

5. A tube shaft according to claim 4, wherein the sections (17,18) are provided with means (19) for locking the two sections with respect to one another in at least two positions.

6. A tube shaft according to claim 3, wherein the sections (17,18) are provided with means (19) for locking the two sections with respect to one another in at least two positions.

7. A tube shaft according to claim 2, wherein one of the tube shaft sections is an integrated part of the tube handle (15).

8. A tube shaft according to claim 7, wherein the sections (17,18) are provided with means (19) for locking the two sections with respect to one another in at least two positions.

9. A tube shaft according to claim 2, wherein the sections (17,18) are provided with means (19) for locking the two sections with respect to one another in at least two positions.

10. A tube shaft according to claim 1, wherein the tube shaft section (17) disposed near the tube handle has a larger outer diameter than the tube shaft section (18) disposed near the nozzle (13).

11. A tube shaft according to claim 10, wherein one of the tube shaft sections is an integrated part of the tube handle (15).

12. A tube shaft according to claim 11, wherein the sections (17,18) are provided with means (19) for locking the two sections with respect to one another in at least two positions.

13. A tube shaft according to claim 10, wherein the sections (17,18) are provided with means (19) for locking the two sections with respect to one another in at least two positions.

14. A tube shaft according to claim 1, wherein one of the tube shaft sections is an integrated part of the tube handle (15).

15. A tube shaft according to claim 14, wherein the sections (17,18) are provided with means (19) for locking the two sections with respect to one another in at least two positions.

16. A tube shaft according to claim 1, wherein the sections (17,18) are provided with means (19) for locking the two sections with respect to one another in at least two positions.

* * * * *

UNITED STATES PATENT AND TRADEMARK OFFICE

CERTIFICATE OF CORRECTION

PATENT NO. : 6,101,673
DATED : August 15, 2000
INVENTOR(S) : Edin

It is certified that error appears in the above-identified patent and that said Letters Patent is hereby corrected as shown below:

CLAIMS:

Claim 5,
Line 1, delete "4", and insert therefor -- 3 --.

Claim 6,
Line 1, delete "3", and insert therefor -- 10 --.

Claim 8,
Line 1, delete "7", and insert therefor -- 4 --.

Claim 12,
Line 1, delete "11", and insert therefor -- 14 --.

Claim 13,
Line 1, delete "10", and insert therefor -- 7 --.

Claim 15,
Line 1, delete "14", and insert therefor -- 4--.

Signed and Sealed this

Seventh Day of August, 2001

*Attest:*

Nicholas P. Godici

*Attesting Officer*

NICHOLAS P. GODICI
*Acting Director of the United States Patent and Trademark Office*